US006070658A

United States Patent [19]

Cipriani

[11] Patent Number: 6,070,658

[45] Date of Patent: Jun. 6, 2000

[54] PLATE FOR PLATE-TYPE HEAT EXCHANGER, AND HEAT EXCHANGER PROVIDED WITH SUCH PLATE

[76] Inventor: Luca Cipriani, 6, Via Marsala, I-37128 Verona, Italy

[21] Appl. No.: 08/945,977

[22] PCT Filed: May 16, 1996

[86] PCT No.: PCT/IT96/00099

§ 371 Date: Nov. 17, 1997

§ 102(e) Date: Nov. 17, 1997

[87] PCT Pub. No.: WO96/37746

PCT Pub. Date: Nov. 28, 1996

[30] Foreign Application Priority Data

May 25, 1995 [IT] Italy ..... VR95A0045

[51] Int. Cl.[7] ..... F28F 3/08

[52] U.S. Cl. ..... 165/166; 165/167; 165/78; 165/DIG. 365; 165/DIG. 367

[58] Field of Search ..... 165/78, 167, DIG. 365, 165/DIG. 367, 166

[56] References Cited

U.S. PATENT DOCUMENTS

| | | | |
|---|---|---|---|
| 2,550,339 | 4/1951 | Ehrman | 165/167 |
| 2,699,324 | 1/1955 | Goodman | 165/167 |
| 4,184,542 | 1/1980 | Sumitomo | 165/166 |
| 4,284,135 | 8/1981 | Almqvist et al. . | |
| 4,781,248 | 11/1988 | Pfeiffer | 165/167 |
| 5,056,590 | 10/1991 | Bohn | 165/78 |

FOREIGN PATENT DOCUMENTS

| | | | |
|---|---|---|---|
| 64107 | 11/1945 | Denmark | 165/167 |
| 0 503 080 | 9/1992 | European Pat. Off. . | |
| 0 526 679 | 2/1993 | European Pat. Off. . | |
| 1 064 539 | 10/1958 | Germany . | |
| 2 049 909 | 12/1980 | United Kingdom . | |
| WO 87/01189 | 2/1987 | WIPO . | |
| WO 93/06426 | 4/1993 | WIPO . | |

*Primary Examiner*—Allen Flanigan
*Attorney, Agent, or Firm*—Evenson, McKeown, Edwards & Lenahan, P.L.L.C.

[57] ABSTRACT

A plate-type heat exchanger is provided with a series of superimposed metallic plates defining a thermal exchange circuit. Each plate is provided with a peripheral groove housing a sealing gasket, said groove lying on a plane (C) placed at a different level in respect of the plane (B) on which the thermal exchange circuit lies.

This feature allows the height of the thermal exchange circuit to be kept very small, e.g. 2–2.2 mm, and this enables very high thermal exchange rates between the exchanger circuits to be reached.

Furthermore, the groove for housing the sealing gasket which is formed has a sufficient height for allowing the walls of the groove to be clamped by means of a clamping and squeezing machine in order to form, in the inner side of the groove, a series of projections suitable for holding firmly positioned the sealing gasket, which is on its turn provided with a series of cavities conjugated to said projections.

10 Claims, 3 Drawing Sheets

PLATE FOR PLATE-TYPE HEAT EXCHANGER, AND HEAT EXCHANGER PROVIDED WITH SUCH PLATE

BACKGROUND OF THE INVENTION

The present invention relates to a plate-type heat exchanger. Such heat exchanger is disclosed, for instance, in DE-B-1 064 539.

The invention may be mainly applied in the field of thermo-mechanical industry.

Plate-type heat exchanger devices are well known in the art.

These devices are constituted by a fixed and a movable endplate, one or both of them being provided, according to different applications, with inlet and outlet connections for fluids, and with a pack of metallic plates, generally stainless steel plates, disposed between said endplates.

Said metallic plates, which are bored close to their angled edges in order to allow the circulation of the fluids, constitute the surface of thermal exchange between the fluids and are provided with a series of ribs, in order to increase the surface and the fluid turbulence; said ribs are generally disposed according to a herringbone or a so-called laundress-board pattern.

Furthermore, the periphery of such plates is provided with sealing gaskets made of an elastic, rubber-like material, which delimit and physically separate the pair of channels formed inside of the heat exchanger and within which the fluids flow.

This type of device is generally used in applications of various kinds, e.g. for instantaneously producing sanitary hot water by means of a boiler, with or without buffers, or for swimming-pool heating by means of a boiler, or for a district-heating network.

Obviously, in accordance with particular applications, the devices are differently dimensioned in what concerns the surface and the number of plates, and are provided with different feeding circuits.

The peripheral sealing gaskets play a determinant role in the operativity of plate-type heat exchangers.

In fact, said gaskets need to be made of high quality materials allowing the gaskets to carry out a perfect seal at high temperatures and pressures, as well as to hold their efficiency even after thousands of hours of operation.

Furthermore, they should perfectly match to their suitable grooves which, on their turn, should allow the gaskets to be placed against possibly vertical walls, in order to assure a good support against the thrust which is exerted on the gasket from the inner side of the exchanger and this, particularly, in proximity of the fluid inlet bores.

The background art proposes different solutions in order to allow the gasket to be correctly placed inside of the groove.

A first known solution provides for the use of a suitable glue in order to stick the gasket on the groove's bottom.

This solution involves a plurality of disadvantages and drawbacks, which are due to high material and labour costs for carrying out the sticking operation, as well as to difficulties for upkeeping the plates in the case where a gasket has to be replaced.

In fact, a sticked gasket should be replaced by eliminating, by means of a suitable solvent, the old bonding agent; this operation should be carried out with care, in order to avoid damaging of the plate.

Thereafter, the groove should be carefully cleaned, and a new glue layer is placed in the same; then, a new gasket is placed into the groove and it has to be waited that it perfectly adheres to its seat.

This involves remarkable loss of time and high costs.

According to another known solution, which does not provide for the use of any bonding agents, the periphery of the gasket is provided with a series o substantially cylindrical protuberances which are suitable for being housed, by exerting a pressure on them, into corresponding holes which are present along the external periphery of the plate.

However, this solution involves drawbacks too, since it requires a very high precision for positioning the gasket relative to the plate, in such a way as each protuberance is aligned to a corresponding plate hole.

A further known solution provides for a series of tabs which are made of the same rubber material as the gasket and which are formed on the external periphery of the gasket.

These tabs are inserted, in operation, into cavities which are formed between the upper and lower surfaces of the plate, and they allow a sufficiently quick positioning of the gasket into the groove.

However, this solution involves drawbacks too, since the gasket is positioned in a rather rough way relative to the groove; furthermore, since the fastening tabs are necessarily made of rubber, they cannot show a high strength against the thermal and mechanical stress which a gasket normally undergoes during its working life.

As a result, the gasket gets frequently out of the groove, thereby causing leakages in the heat exchanger.

Another solution which has been proposed, and which exhibits the advantage of immediately positioning the gasket into the plate groove, consists in providing for a series of cavities which are disposed at given distances from each other in the gasket body, while the plate is provided with a series of projections which are obtained by automatically clamping and squeezing with tongs the groove walls, said projections being suitable for being inserted into said cavities and keeping then the gasket spot-fastened to the plate.

However this solution, which is extremely convenient for rapidly replacing a gasket, requires a height groove of at least 3 mm in order to reliably use the clamping and squeezing machine; now, in order to obtain high thermal exchange rates it is necessary that the height of the plate (and, more precisely, the height of the channels forming the thermal exchange circuit) does not exceed a given value, e.g. 2–2.2 mm. For this reason, this solution may be used, according to the background art, only for heat exchangers having a relatively low thermal exchange rate and a plate height exceeding 3 mm.

Another problem exhibited by plate-type heat exchangers is constituted by leakages in correspondence of the fluid inlet and outlet holes.

It has been attempted to solve this problem by using gaskets having a dovetail profile which expands when a fluid under pressure-is applied against the gasket itself.

However, also this solution has revealed to be unsatisfactory, since the metallic plate, which is not supported on its back by an element which may stand the pressure exerted by the fluid, bends in the region around the inlet and outlet holes; this may happen since the plates which are normally used are not sufficiently stiffened in proximity of the fluid inlet and outlet holes, and the dovetail-shaped gaskets cannot entirely compensate the plate deflection.

As a result, the heat exchanger shows leakages which are higher, the higher is the operating pressure; in no case, according to the background art, operating pressures exceeding 25 bar may be reached.

Thus, although the problem of positioning the gasket is well known in the art, nobody has proposed a reliable solution which allows a plate-type heat exchanger to be operated at very high operating pressures, e.g. 45–50 bar or even more.

Finally, a further problem raised by the plate-type heat exchangers known in the art is constituted by the difficulty of centering the various plates in respect of each other; it appears to be clear that, in the case where the plates are not perfectly centered in respect to each other, some regions are formed in which the channels of a plate do not perfectly match to the protuberances of an adjacent plate. This causes a faulty working of the exchange circuit and it is a source of potential fluid leakages from the heat exchanger.

WO-A-93/06 426 discloses a plate heat exchanger having a welded plate pair comprising first and second plates which are welded together at a contact region, a by-pass area being defined between the plates on the inboard side of the contact region. The plates are shaped and arranged so that a second by-pass area similar to the first is defined between the second -plate and the first plate of an adjacent, similar, plate pair.

EP-A-0 503 080 relates to a layer-built heat exchanger for exchanging heat between a first coolant and a second coolant. According to the invention, partitions are provided in a plate on a primary side and in a plate on a secondary side to form channels therein. A plurality of the plates on the primary side and of the plates on the secondary side are laminated one upon another with respective seal plates therebetween. Each of the partitions of the plates on the secondary side are located at positions opposed to each of the channels of the plates on the primary side and each of the partitions of the plates of the primary side are located at positions opposed to each of the channels of the plates on the secondary side.

SUMMARY OF THE INVENTION

The present inventions aims to set aside the disadvantages and drawbacks which are typical of the background art and to provide, thus, for an extremely improved plate-type heat exchanger, in which the single gaskets may be replaced and positioned in a very quick way, which shows a very high thermal exchange rate (having a reduced channel height).

This is achieved by a plate-type heat exchanger of the previously mentioned type and having the features disclosed in the characterizing part of claim 1.

The dependent claims describe advantageous forms of embodiment of the invention such as, for instance, a form of embodiment according to which the heat exchanger is provided with reliable self-centering means allowing the plates to be always perfectly centered in respect to each other while assemblying the heat exchanger.

The plate-type heat exchanger according to the present invention is provided with a series of plates where the plane on which lies the thermal exchange circuit and the plane on which lies the groove housing the sealing gasket are offset in respect of each other.

More particularly, the groove housing the sealing gasket lies on a plane which is at a lower level than the plane on which lies the thermal exchange circuit.

This feature allows the height of the thermal exchange circuit to be kept very small, e.g. 2–2.2 mm; this enables very high thermal exchange rates between the exchanger circuits to be reached; furthermore, the groove for housing the sealing gasket which is formed has a sufficient height for allowing the walls of the groove to be clamped by means of a clamping and squeezing machine in order to form, in the inner side of the groove, a series of projections suitable for holding firmly positioned the sealing gasket, which is on its turn provided with a series of cavities conjugated to said projections.

According to an advantageous form of embodiment of the invention the sealing gasket, which is made of a resilient material, is formed by a first portion, which is inserted into the peripheral groove of the plate, and by a second portion, which is joined to the first one, and which is formed by an O-ring having a substantially circular cross-section; according to this form of embodiment, said second O-ring shaped portion is placed inside of a seat which is formed at the same level as the exchange circuit, along the periphery of the latter, when superposing two plates.

The particular shape of said second portion allows important advantages to be achieved from the point of view of sealing against possible fluid leakages when the fluid flows at high-pressure inside of the heat exchanger: in fact, the effort is exerted by the fluid on a reduced portion of the O-ring shaped gasket periphery; the latter warps inside of its seat and releases the effort on the seat walls, thereby increasing the pressure of the gasket on the walls and preventing any fluid leakage from the heat exchanger.

According to another important feature of the invention, the plate is provided with a series of stiffening ribs and/or cavities in the region close to the fluid inlet and outlet holes.

These ribs and/or cavities remarkably stiffen the plate just in the region where the plate undergoes the major warping efforts caused by the fluid pressure; the shape of the ribs is designed in such a way as they abut against each other, thereby forming, when adjacent plates are superposed, bearing surfaces which give a significant contribution, together with the O-ring shaped sealing gasket, to preventing fluid leakages in the weakest regions of the plate, i.e. close to the fluid inlet and outlet holes.

According to another important feature of the invention the plate is provided, in correspondence of its central upper and lower ends, with reliable self-centering means allowing the plates to be perfectly coupled and superposed to each other when the heat exchanger is being assembled.

These self-centering means are constituted by steps whose height is equal to the sum of height of the groove housing the sealing gasket plus the height of the thermal exchange circuit, and they co-operate with conjugated regions having the same depth which are present in the adjacent plates.

The fact of providing these steps having a depth which is more than the double than the height of the thermal exchange circuit allows an easy centering operation of the plates to be carried out, although the circuit height is relatively small in order to increase the thermal exchange rate.

In the case where all the above described features are implemented in a single plate, a heat exchanger may be assembled having quickly replaceable gaskets, very high efficiency rates and which is suitable to stand an operating pressure which is not to be reached by means of the heat exchangers known in the art, since it may stand an operating pressure even exceeding 50–60 bar.

BRIEF DESCRIPTION OF THE DRAWINGS

Other features and advantages of the invention will become apparent by reading the following description, given as a non-limiting example, with the help of the figures illustrated in the attached drawings, in which.

DETAILED DESCRIPTION OF PREFERRED EMBODIMENT

Figure 1:
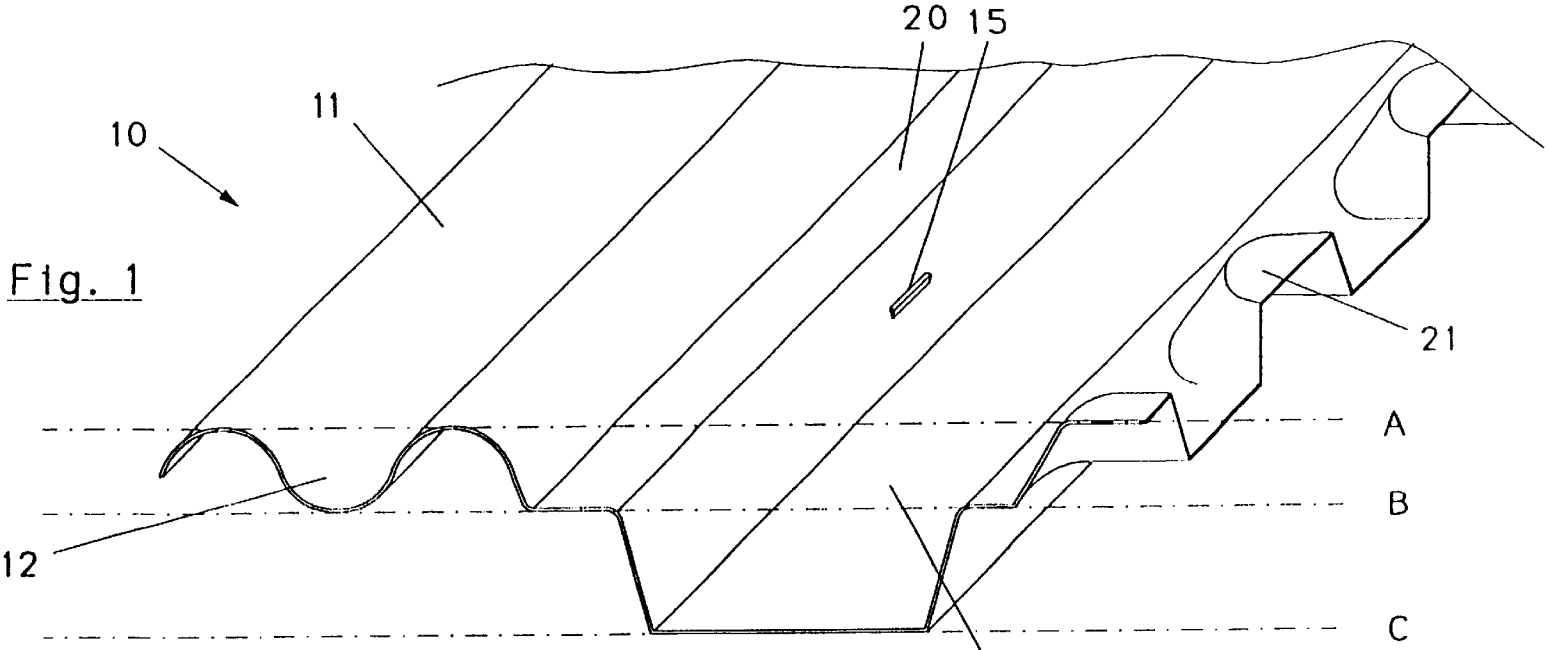
FIG. 1 shows a schematical perspective view of a peripheral portion of a plate for heat exchanger according to the invention.
Figure 2:
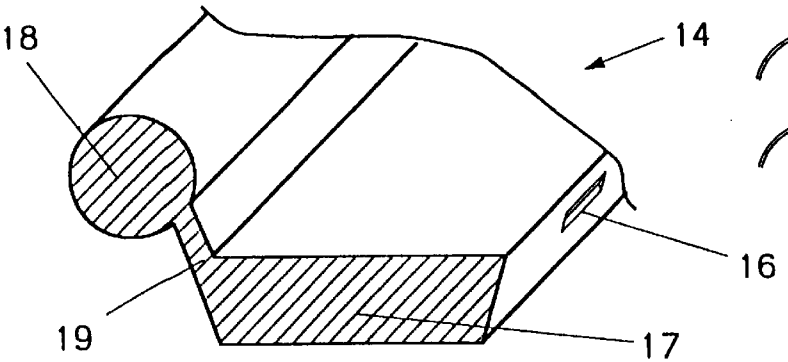
FIG. 2 shows a schematical perspective view of a portion of a sealing gasket suitable for cooperating with a plate according to the invention.

In the figures, reference sign 10 generally indicates a plate for plate-type heat exchanger according to the invention.

Plate 10, which is made of a metallic material, comprises a series of ribs 11 which define channels 12 forming a pair of thermal exchange circuits for fluids flowing on both sides of plate 10.

Furthermore, plate 10 comprises a peripheral groove 13 defining a seat for housing a sealing gasket 14 made of a resilient material.

As it may be noted in FIG. 1, the thermal exchange circuits formed by channels 12 are placed inside of a volume defined by a pair of planes A and B, while said peripheral groove 13 is disposed inside of a volume which is delimited by said plane B and a third plane C, which is at a different level, in this case at a lower level, relative to plane B.

The fact of placing groove 13 at a lower level in respect of the thermal exchange circuits allows gasket 14 to be fastened in a very practical and quick way inside of groove 13.

In fact, the sloping walls of groove 13 are provided with projections 15 obtained by automatically clamping and squeezing the walls by means of tongs belonging to a clamping and squeezing machine; these projections are inserted, while assemblying gasket 14 into groove 13, into respective cavities 16 which are provided on the walls of gasket 14.

Thus, the gasket may be assembled into the groove just by exerting a slight pressure on the gasket body in order to have the projections 15 inserted into cavities 16.

Furthermore, this solution allows the height of the thermal exchange circuits to be reduced at will, thereby causing a dramatical increase of the thermal exchange rate.

As a way of example, the distance between planes A and B may range between 1.8 and 2.2 mm, what assures a very high thermal exchange rate, while the height of groove 13 (which corresponds to the distance between planes B and C) may be set at approx. 3 mm, thereby allowing the groove walls to be easily clamped and squeezed in order to form projections 15.

According to this particular form of embodiment gasket 14 of plate 10 comprises a first portion 17 which is suitable for being inserted into groove 13, and a second portion 18, having a circular cross-section, which is joined to the first portion by means of a protuberance 19 which projects outwardly from a wall of said first portion 17.

Figure 3:
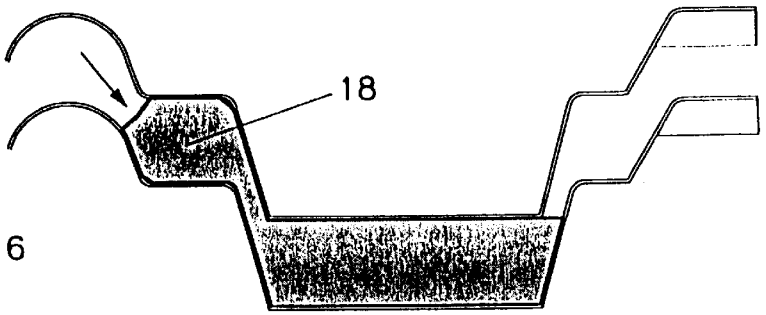
FIG. 3 shows a schematical front view of the region where a pair of plates are superposed, a sealing gasket being interposed between said plates.

The configuration of plate 10 is designed in such a way as said second portion 18 bears on a flat portion 20 which is adjacent to the thermal exchange circuits 12; furthermore, when assemblying the heat exchanger, the lower part of flat portion 20 of a plate which is being superposed to another plate forms, together with a wall of groove 13, a seat which entirely houses and bears said second portion 18 of gasket 14 (see FIG. 3).

As a matter of fact, according to this form of embodiment, the exchanger seal is essentially assured by this second portion 18 of gasket 14 inside of the seat defined by the flat portion 20 and by the wall of groove 13: in fact, the effort which is exerted by the fluid under pressure (see the arrow in FIG. 3) acts only on a small region of the periphery of second portion 18 which, consequently, resiliently warps and strongly adheres to the walls of its own seat, thereby preventing any fluid leakage.

This feature allows the heat exchanger to be operated at very high operating pressures, e.g. 50 to 60 bar, without any fluid leakage from the plate edges.

Actually, even applying such pressures, second portion 18 of gasket 14 warps and is. applied very tightly to the walls of said seat, thereby preventing any fluid leakage from the thermal exchange circuits.

Moreover, the circular shape of the cross-section of second portion 18 of gasket 14 provides for a longer life of the gasket itself which, although it works at very high pressures, is naturally keen to resiliently reassume its circular shape without any permanent deformation.

Figure 5:
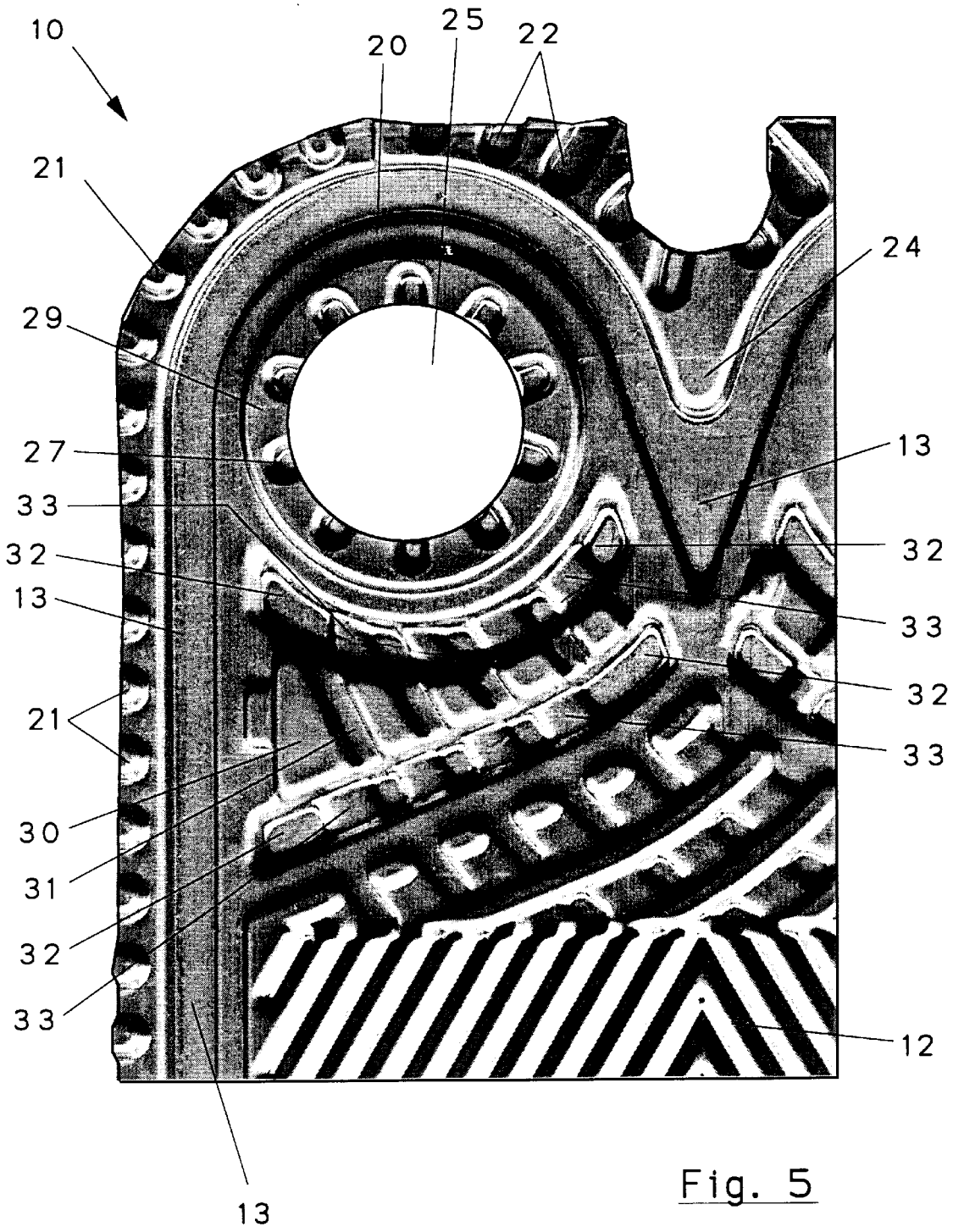
FIG. 5 shows a plan view of a portion of a plate for heat exchanger according to the invention.

FIG. 5 shows a plan view of a plate 10 according to the invention.

This figure shows external stiffening ribs 21 (see also FIGS. 1 and 4), whose tops are placed at the same level as plane A of FIG. 1, i.e. at the same upper level as ribs 11.

It may also be noted in FIG. 5 that, in the central upper region, a first portion 24 is formed which lies on plane A and which is adjacent to groove 13, whose base lies on plane C; consequently, in this central region, a step is formed having a height equal to the distance existing between planes A and C in FIG. 1, that is practically equal to about 5 mm.

This solution enables plates 10 to be reliably self-centered and self-aligned in respect to each other when assemblying the heat exchanger, since each plate is automatically inserted into a guide formed by a deep channel of the adjacent plate, thereby avoiding any alignment problem occurring in superposing the plates, what normally leads to warps on the plates and to leakages of the heat exchanger during its use.

FIG. 5 shows a fluid inlet or outlet hole 25.

As already mentioned, in the plate-type heat exchangers the region around hole 25 is a rather weak one from the point of view of fluid leakages during the exchanger operation, and this risk progressively increases by increasing the operating pressure; in practice, it is known that it is quite impossible to operate a plate-type heat exchanger at a pressure exceeding 25 bar just because of fluid leakages occurring in this region.

Plate 10 according to the invention is provided with means suitable for avoiding fluid leakages in the region around hole 25, said means allowing the exchanger to be operated at a pressure which even exceeds 50 bar.

Figure 4:
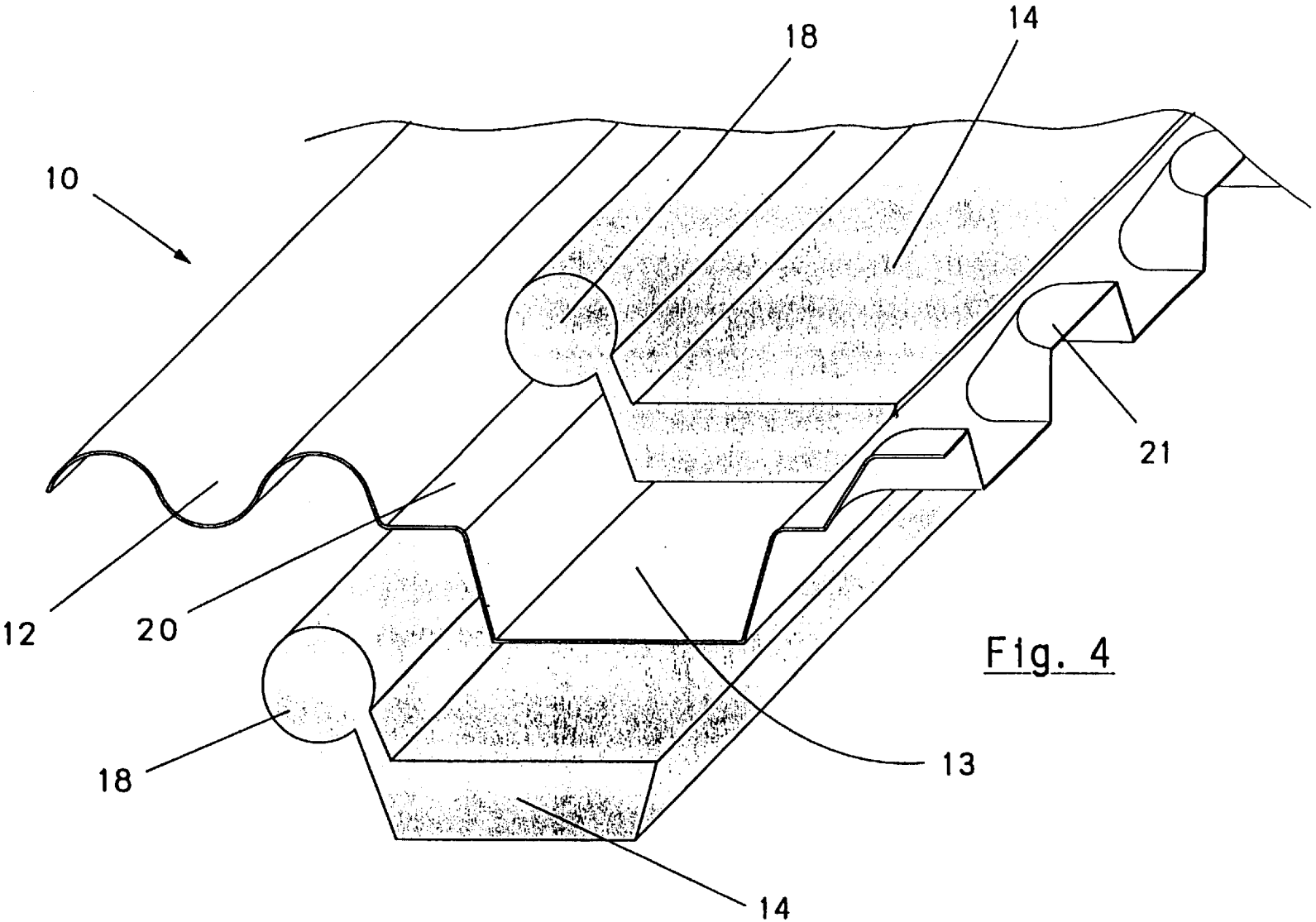
FIG. 4 shows a schematical perspective view of a portion of a plate for heat exchanger according to the invention, said plate being provided with a pair of sealing gaskets.

In this specific case, it may be noted in FIG. 4 that hole 25 is encircled by a series of reinforcing grooves 27 which are made on a plane 29 lying at the same level as plane B (see FIG. 1), while outside of this region, in close proximity thereof, there is the flat portion 20 (which also lies on plane B) which bears said second portion of gasket 14.

Still, in the region beneath hole 25 there are a series of reinforcing ribs 30 lying on plane A, a series of grooves 31 lying on plane B, a series of cavities 32 the bases of which lie on plane C, and a series of ribs 33 the tops of which lie on a plane which is placed between planes B and C.

The alternate disposition of elements 30, 31, 32, 33 described above allows the region underlying hole 25 to be stiffened in a remarkable way, said region being used for placing gasket 14 in correspondence of cavities 32 and ribs 33; furthermore, gasket 14 may comprise some joining extensions (not shown in the figures) which are housed into cavities 31, as well as some protuberances which are inserted into cavities 32.

Since the plate according to the invention shows a high stiffness and a substantial indeformability, it may be produced by pressing metallic sheets having a thickness which is lower (i.e. 0.4–0.6 mm) in respect of the higher sheet thickness-which is adopted for the plates known in the art; this involves clear advantages both from the economical and the technical points of view, since the weight of the individual plates is lower than the weight of the known plates, and since a lower thickness corresponds to a higher thermal exchange rate.

Finally, a plate of this kind, which is provided with a gasket 14 as described above, allows a heat exchanger to be assembled which is characterised by very high operating pressure, even higher than 50 bar, thereby achieving the scopes of the invention.

What is claimed:

1. Plate-type heat exchanger comprising a plurality of superimposed substantially rectangular-shaped metallic plate elements, each element being provided on shorter sides thereof, with holes allowing the passage of respective first and second fluids which flow inside of separate thermal exchange circuits, said plate forming a thermal exchange surface for said fluids and comprising a series of ribs suitable for increasing the thermal exchange surface and inducing a turbulence of said fluids, the periphery of said plate being further provided with a groove suitable for housing a sealing gasket made of a resilient material, said gasket further encircling a respective pair of said holes, said thermal exchange circuits lying on a first plane and a second plane, respectively, which are offset, whereby said groove housing said sealing casket lies on a third plane placed at a lower level in respect of the second plane, wherein the thermal exchange circuits have a height in a range between 1.8 and 2.4 mm, in order to achieve a very high thermal exchange rate, further wherein said groove for housing said gasket has a height of about 3 mm in order to allow the groove walls to be easily clamped and squeezed to form projections which are inserted into respective cavities formed on the walls of said gasket, wherein each plate element is provided with a pair of self-aligning and self-centering steps suitable for facilitating an assembling operation of a heat exchanger, thereby avoiding any plate deformation, said steps being respectively placed in central upper and lower positions of the plate elements, an upper portion of said step lying on the first plane delimiting the thermal exchange circuits, while a lower portion of said step lies on the third plane where said groove lies.

2. Plate-type heat exchanger according to claim 1, wherein each plate element comprises a peripheral flat portion which is adjacent to the thermal exchange circuits and which lies on the same second plane on which said thermal exchange circuits lie.

3. Plate-type heat exchanger according to claim 2 or 1, wherein each plate element further comprises additional grooves and cavities suitable for stiffening the plate surface, said grooves and cavities being placed in close proximity of said holes, said grooves and cavities lying on the third plane on which said groove for housing said gasket lies.

4. Plate-type heat exchanger according to claim 2 or 1, wherein each plate element is made from a metallic sheet having a thickness ranging from 0.4 and 0.6 mm.

5. Plate-type heat exchanger comprising a plurality of superimposed substantially rectangular-shaped metallic plate elements, each element being provided on shorter sides thereof, with holes allowing the passage of respective first and second fluids which flow inside of separate thermal exchange circuits, said plate forming a thermal exchange surface for said fluids and comprising a series of ribs suitable for increasing the thermal exchange surface and inducing a turbulence of said fluids, the periphery of said plate being further provided with a groove suitable for housing a sealing gasket made of a resilient material, said casket further encircling a respective pair of said holes, said thermal exchange circuits lying on a first plane and a second plane, respectively, which are offset, whereby said groove housing said sealing gasket lies on a third plane placed at a lower level in respect of the second plane, wherein the thermal exchange circuits have a height in a range between 1.8 and 2.4 mm, in order to achieve a very high thermal exchange rate, further wherein said groove for housing said gasket has a height of about 3 mm in order to allow the groove walls to be easily clamped and squeezed to form projections which are inserted into respective cavities formed on the walls of said gasket, wherein each plate element comprises a peripheral flat portion which is adjacent to the thermal exchange circuits and which lies on the same second plane on which said thermal exchange circuits lie, and wherein said gasket comprises a first portion suitable for being inserted into said groove and a second portion joined to said first portion by means of a protuberance starting from a wall of said first portion, and wherein said second portion is placed on said peripheral flat portion.

6. Plate-type heat exchanger according to claim 2, wherein each plate element is provided with self-aligning and self-centering means suitable for facilitating an assembling operation of a heat exchanger, thereby avoiding any plate deformation.

7. Plate-type heat exchanger according to claim 2, wherein each plate element comprises additional grooves and cavities suitable for stiffening the plate surface, said grooves and cavities being placed in close proximity of said holes, said grooves and cavities lying on the third plane on which said groove for housing said gasket lies.

8. Plate-type heat exchanger according to claim 2, wherein each plate element is made from a metallic sheet having a thickness ranging from 0.4 and 0.6 mm.

9. Plate-type heat exchanger comprising a plurality of superimposed substantially rectangular-shaped metallic plate elements, each element being provided on shorter sides thereof, with holes allowing the passage of respective first and second fluids which flow inside of separate thermal exchange circuits, said plate forming a thermal exchange surface for said fluids and comprising a series of ribs suitable for increasing the thermal exchange surface and inducing a turbulence of said fluids, the periphery of said plate being further provided with a groove suitable for housing a sealing casket made of a resilient material, said casket further encircling a respective pair of said holes, said thermal exchange circuits lying on a first plane and a second plane, respectively, which are offset, whereby said groove housing said sealing casket lies on a third plane placed at a lower level in respect of the second plane, wherein the thermal exchange circuits have a height in a range between 1.8 and 2.4 mm, in order to achieve a very high thermal exchange rate, further wherein said groove for housing said gasket has a height of about 3 mm in order to allow the groove walls to be easily clamped and squeezed to form projections which are inserted into respective cavities formed on the walls of said gasket, wherein each plate element is provided with a self-aligning and self-centering means suitable for facilitating an assembling operation of a heat exchanger, thereby avoiding any plate deformation, wherein said gasket comprises a first portion suitable for being inserted into said groove and a second portion joined to said first portion by means of a protuberance starting from a wall of said first portion, and in that said second portion is placed on said peripheral flat portion.

10. Plate-type heat exchanger according to claim 1, wherein said gasket comprises a first portion suitable for being inserted into said groove and a second portion joined to said first portion by means of a protuberance starting from a wall of said first portion, and wherein said second portion is placed on said peripheral flat portion.

* * * * *